US011721892B2

(12) United States Patent
Johansson et al.

(10) Patent No.: US 11,721,892 B2
(45) Date of Patent: Aug. 8, 2023

(54) SURFACE WAVE REDUCTION FOR ANTENNA STRUCTURES

(71) Applicant: Telefonaktiebolaget LM Ericsson (publ), Stockholm (SE)

(72) Inventors: Stefan Johansson, Romelanda (SE); Hawai Rashid, Kungälv (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 165 days.

(21) Appl. No.: 17/270,540

(22) PCT Filed: Sep. 21, 2018

(86) PCT No.: PCT/EP2018/075688
§ 371 (c)(1),
(2) Date: Feb. 23, 2021

(87) PCT Pub. No.: WO2020/057756
PCT Pub. Date: Mar. 26, 2020

(65) Prior Publication Data

US 2021/0359404 A1 Nov. 18, 2021

(51) Int. Cl.
*H01Q 1/52* (2006.01)
*H01Q 9/04* (2006.01)

(52) U.S. Cl.
CPC ..... *H01Q 1/52* (2013.01); *H01Q 9/0407* (2013.01)

(58) Field of Classification Search
CPC ..... H01Q 1/52; H01Q 9/0407; H01Q 9/0414; H01Q 1/523; H01Q 21/065; H01Q 1/521
See application file for complete search history.

(56) References Cited

U.S. PATENT DOCUMENTS 6,462,710 B1 * 10/2002 Carson ..... H01Q 21/065 343/770
2007/0273588 A1 * 11/2007 Kim ..... H01Q 9/0407 343/700 MS (Continued)

FOREIGN PATENT DOCUMENTS

CN 101645539 A * 2/2010
JP S59101908 A 6/1984

(Continued)

OTHER PUBLICATIONS

Razavi, S. et al., "2x2-Slot Element for 60-GHz Planar Array Antenna Realized on Two Doubled-Sided PCBs Using SIW Cavity and EBG-Type Soft Surface Fed by Microstrip-Ridge Gap Waveguide", IEEE Transactions on Antennas and Propagation, vol. 62 No. 9, Sep. 1, 2014, pp. 4564-4573, IEEE.

*Primary Examiner* — Dieu Hien T Duong
(74) *Attorney, Agent, or Firm* — Coats & Bennett, PLLC

(57) ABSTRACT

The present disclosure relates to a planar antenna structure (100, 200, 800, 900) comprising at least one radiating aperture (101, 201 801, 901), adapted for a certain working frequency band, and an electrically conducting surface structure (102, 202, 802, 902) that is constituted by at least one surface part and is surrounding at least one radiating aperture (101, 201, 801, 901) and having a certain extension (T). The planar antenna structure (100, 200, 800, 900) comprises at least one continuous groove (103, 104; 203, 204; 803, 804; 903, 904) that forms a slot in the surface structure (102, 202, 802, 902), where each groove (103, 104) is defined by an at least virtual electric wall that is electrically connected to the surface structure (102, 202, 802, 902) and forms a continuous electromagnetic wall in the surface structure (102, 202, 802, 902) at the working frequency band. In this manner, that propagation of surface waves via (Continued)

the at least one groove (103, 104; 203, 204; 803, 804; 903, 904) is reduced.

20 Claims, 10 Drawing Sheets

(56) References Cited

U.S. PATENT DOCUMENTS

| | | | |
|---|---|---|---|
| 2008/0224938 | A1 | 9/2008 | Udagawa et al. |
| 2018/0219272 | A1 | 8/2018 | Baheti et al. |

FOREIGN PATENT DOCUMENTS

| | | | |
|---|---|---|---|
| JP | 2005091238 | A | 4/2005 |
| WO | 2016061021 | A1 | 4/2016 |
| WO | 2018001921 | A1 | 1/2018 |

* cited by examiner

SURFACE WAVE REDUCTION FOR ANTENNA STRUCTURES

TECHNICAL FIELD

The present disclosure relates to antenna structures comprising at least one radiating aperture and an electrically conducting surface structure that is constituted by at least one surface part and is surrounding at least one radiating aperture. The present disclosure also relates to an antenna mounting assembly.

BACKGROUND

In wireless communication networks there is radio equipment that in many cases comprises so-called advanced antenna system (AAS), for example 5G mobile communication system. AAS is a key component to improve capacity and coverage by making use of the spatial domain, and a challenge is to develop cost efficient technologies and building practice to meet market cost demands on this type of products.

In the mm-wave area, such as about 10 GHz and above, it is attractive using a highly integrated building practice based on multi-layer PCB (printed circuit board) or LTCC (low temperature co-fired ceramics), or similar multi-layer technologies.

Classical patch antennas printed on dielectric substrates, as well as other types of antennas having one or more antenna apertures in the vicinity of an electrically conducting surface structure, suffer from excitation of substrate waves. This means that, for example, when integrating an antenna or an array antenna into a PCB structure or similar, the antenna radiation performance becomes very sensitive to the overall PCB structure as well as to nearby objects and structures due to that the surface waves propagate along the surface of the PCB. These surface waves interferes with neighboring antenna elements in an antenna array system and cause edge effects that will lead to a scattered field that interferes with the intended antenna radiation. In turn, this may deteriorate the desired radiation characteristics and antenna performance.

It is therefore desired to reduce and control surface wave propagation along an electrically conducting surface structure and thereby also make antenna radiation performance less sensitive to the overall antenna structure as well as to nearby structures and objects placed beside the antenna.

SUMMARY

It is therefore an object of the present disclosure to provide an antenna structure, a planar antenna structure and an antenna mounting assembly where surface wave propagation along an electrically conducting surface structure is controlled and reduced.

This object is obtained by means of a planar antenna structure comprising at least one radiating aperture, adapted for a certain working frequency band, and an electrically conducting surface structure. The electrically conducting surface structure is constituted by at least one surface part, is surrounding at least one radiating aperture and has a certain extension. The planar antenna structure comprises at least one continuous groove that forms a slot in the surface structure. Each groove is defined by an at least virtual electric wall that is electrically connected to the surface structure and forms a continuous electromagnetic wall in the surface structure at the working frequency band such that propagation of surface waves via the at least one groove is reduced.

In this manner, antenna radiation performance is significantly improved since propagation of unwanted surface waves is reduced, and then undesired scattered field interfering with the intended antenna radiation is reduced as well.

According to some aspects, each groove comprises at least one step in height, where each step in height at least initially is perpendicular to the extension at the step in height.

According to some aspects, each groove is formed in a dielectric material.

According to some aspects, each groove comprises metal-plated walls.

According to some aspects, each groove comprises a plurality of via connections.

In this way, the grooves are provided in an inexpensive and uncomplicated manner.

According to some aspects, each groove comprises a plurality of step in heights, where two adjacent step in heights have mutually perpendicular extension.

In this way, size limitations of the planar antenna structure can be handled.

According to some aspects, each groove surrounds a plurality of radiating apertures.

According to some aspects, the planar antenna structure comprises at least two pluralities of radiating apertures.

In this way, coupling effects between groups of radiating apertures is reduced, resulting in more equal embedded antenna patterns for orthogonal polarizations, According to some aspects, the grooves are formed by means of protruding walls.

Apart from the above the planar antenna structure, there is also provided herein an antenna structure and an antenna mounting assembly, which display advantages corresponding to the advantages already described for the planar antenna structure.

BRIEF DESCRIPTION OF THE DRAWINGS

The present disclosure will now be described more in detail with reference to the appended drawings, where.

DETAILED DESCRIPTION

Figure 1A:
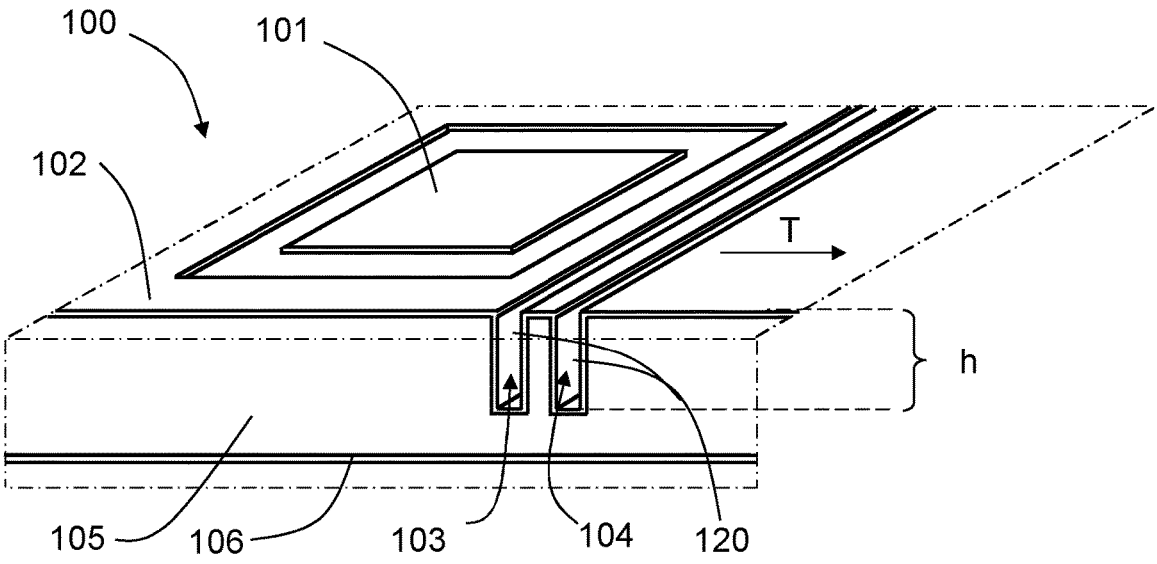
FIG. 1A shows a perspective view of a planar antenna element with surrounding grooves formed by metallization.

Aspects of the present disclosure will now be described more fully with reference to the accompanying drawings. The different devices disclosed herein can, however, be realized in many different forms and should not be construed as being limited to the aspects set forth herein. Like numbers in the drawings refer to like elements throughout.

The terminology used herein is for describing aspects of the disclosure only and is not intended to limit the invention. As used herein, the singular forms "a", "an" and "the" are intended to include the plural forms as well, unless the context clearly indicates otherwise.

With reference to FIG. 1A, showing a perspective view of a first example, there is a planar antenna structure 100 comprising one radiating aperture 101 in the form of a radiating patch element that is adapted for a certain working frequency band. The planar antenna structure 100 comprises a surface structure 102 that comprises an electrically conducting layer that has a certain extension T and surrounds the patch element 101. Both the patch element 101 and the electrically conducting layer 102 are formed in one metal layer that is carried by a dielectric material 105, where the dielectric material 105 has a ground plane 106 formed on a side opposite to the side where the patch element 101 and the electrically conducting layer 102 are formed. The patch element 101 is adapted to be excited in any suitable manner such as probe feed and aperture feed where such feeds are well-known in the art; no such feed is shown for reasons of clarity and is not of importance for the present disclosure.

A detailed example of a stacked patch antenna with a possible feeding will be discussed later.

According to the present disclosure, the planar antenna structure 100 comprises a first continuous groove 103 and a second continuous groove 104, which grooves 103, 104 form slots in the electrically conducting layer 102, where each groove 103, 104 generally is defined by an at least virtual electric wall that is electrically connected to the electrically conducting layer 102.

Each groove further forms a continuous electromagnetic wall in the electrically conducting layer 102 such that propagation of surface waves via the grooves 103, 104 is reduced.

Each groove 103, 104 comprises a step in height h that is perpendicular to the extension T at the step in height h. The grooves 103, 104 are formed as electrically conducting trenches in the dielectric material 105, according to some aspects by means of cutting or milling, and by metal-plating such that metal-plated walls 120 that are in electrical contact with the electrically conducting layer 102 are formed.

Figure 1B:
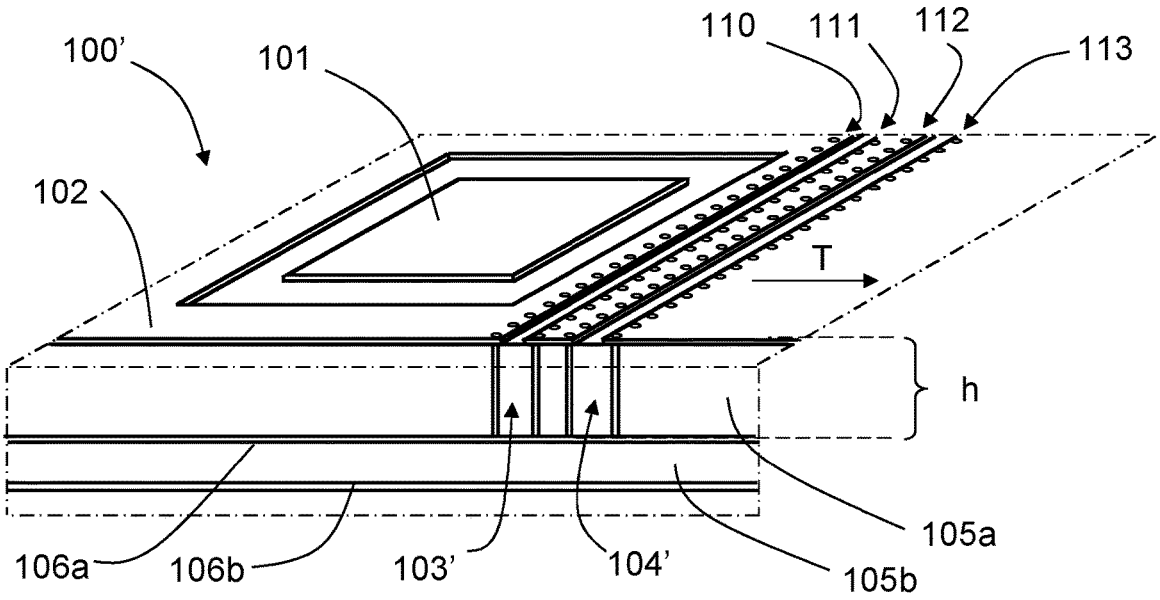
FIG. 1B shows a perspective view of a planar antenna element with surrounding grooves formed by vias and a ground plane.

According to some aspects, with reference to FIG. 1B, showing a second example, there is a planar antenna structure 100' comprising a radiating patch element 101 and an electrically conducting layer 102 as in the previous example. Here, the planar antenna structure 100' comprises a first dielectric layer 105*a* and a second dielectric layer 105*b*, where the dielectric layers 105*a*, 105*b* are separated by a first ground plane 106*a*. The radiating patch element 101 and the electrically conducting layer 102 are formed on a side of the first dielectric layer 105*a* that faces away from the first ground plane 106*a*, and a second ground plane 106*b* is formed on a side of the second dielectric layer 105*b* that faces away from the first ground plane 106*a*.

The planar antenna structure 100' comprises grooves similar 103', 104' to the ones in the first example, which grooves 103', 104' form slots in the electrically conducting layer 102. The grooves are further formed by means of rows of vias 110, 111; 112, 113 that electrically connect the electrically conducting layer 102 to the first ground plane 106*a* such that the vias and the first ground plane 106*a* together form a continuous at least virtual electric wall that is electrically connected to the electrically conducting layer 102.

Figure 2:
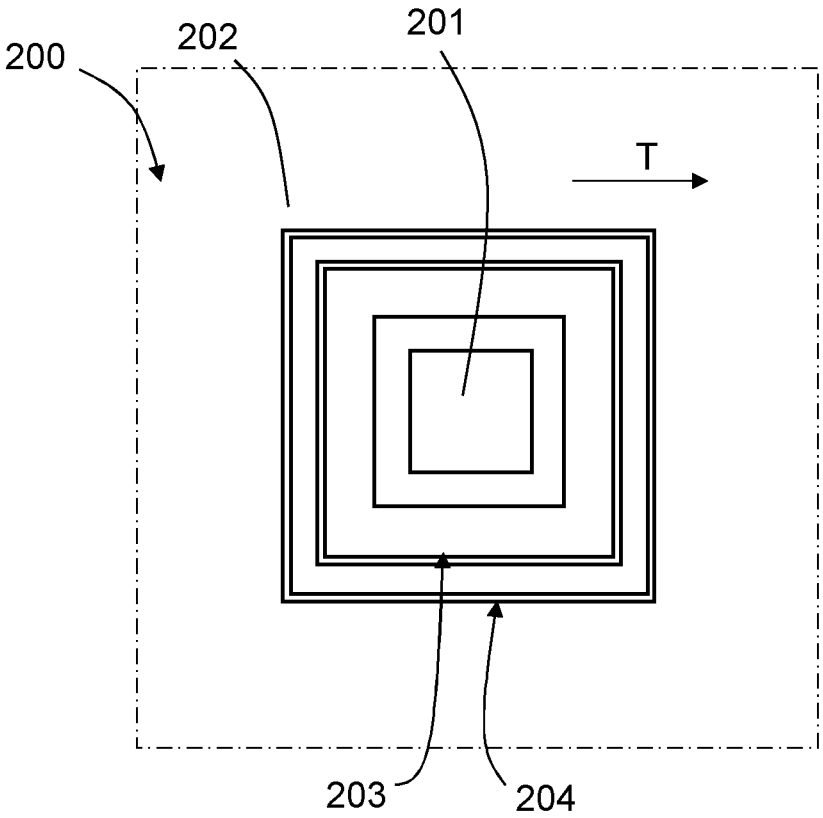
FIG. 2 shows a top view of a planar antenna element with surrounding grooves.

FIG. 2 shows a top view of a third example of a planar antenna structure 200 comprising one patch element 201 that is surrounded by two grooves 203, 204 that form slots in an electrically conducting layer 102 that surrounds the patch element 201.

Figure 3:
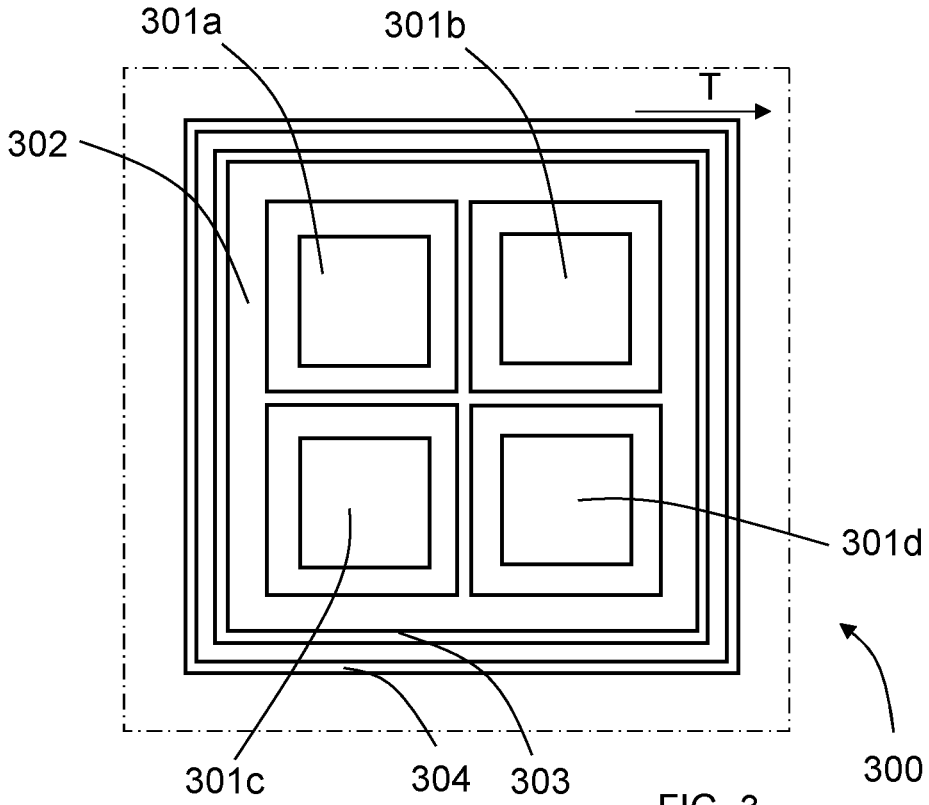
FIG. 3 shows a top view of a planar antenna element array with surrounding grooves.

FIG. 3 shows a top view of a fourth example of a planar antenna structure 300 comprising a group of four squarely arranged patch elements 301*a*, 301*b*, 301*c*, 301*d*, where the group of patch elements 301*a*, 301*b*, 301*c*, 301*d* is surrounded by two grooves 303, 304 that form slots in an electrically conducting layer 302 that surrounds each one of the patch elements 301*a*, 301*b*, 301*c*, 301*d*.

In FIG. 2 and FIG. 3, the grooves can be formed in any suitable way, for example as described with reference to FIG. 1A or FIG. 1B.

Figure 4:
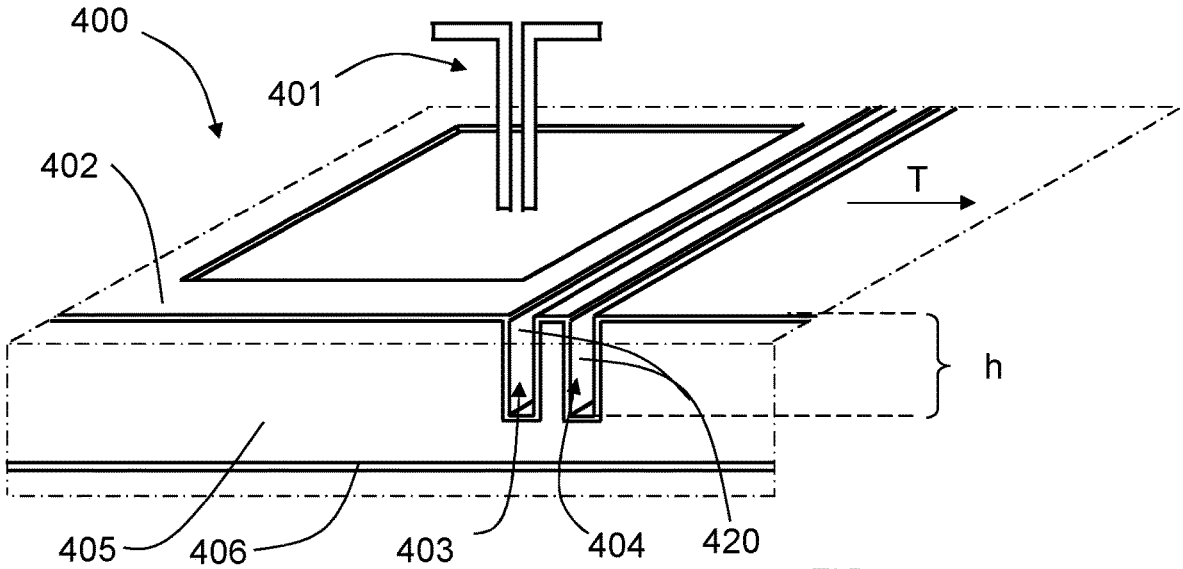
FIG. 4 shows a perspective view of a dipole antenna element with surrounding grooves.

FIG. 4 shows a perspective view of a first example of an antenna structure 400 comprising one radiating aperture 401 in the form of a radiating dipole element that is adapted for a certain working frequency band. The antenna structure 400 comprises a surface structure 402 that comprises an electrically conducting layer that has a certain extension T and surrounds the dipole element 401. The electrically conducting layer 402 is formed in one metal layer that is carried by a dielectric material 405, where the dielectric material 405 has a ground plane 406 formed on a side opposite to the side where the electrically conducting layer 402 is formed. The dipole element 401 is adapted to be excited in any suitable manner as is well-known in the art; no such feed is shown for reasons of clarity and is not of importance for the present disclosure.

In accordance with the present disclosure, the antenna structure 400 comprises a first continuous groove 403 and a second continuous groove 404, which grooves 403, 404 form slots in the surface structure 402. Each groove 403, 404 is generally defined by an at least virtual electric wall that is electrically connected to the electrically conducting layer 402. The grooves 403, 404 further form a continuous electromagnetic wall in the electrically conducting layer 402 at the working frequency band such that propagation of surface waves via the grooves 403, 404 is reduced.

Each groove 403, 404 comprises a step in height h that is perpendicular to the extension T at the step in height h. The grooves 403, 404 are formed as electrically conducting trenches in the dielectric material 405, according to some aspects by means of cutting or milling, and by metal-plating such that metal-plated walls 420 that are in electrical contact with the electrically conducting layer 402 are formed.

Figure 5:
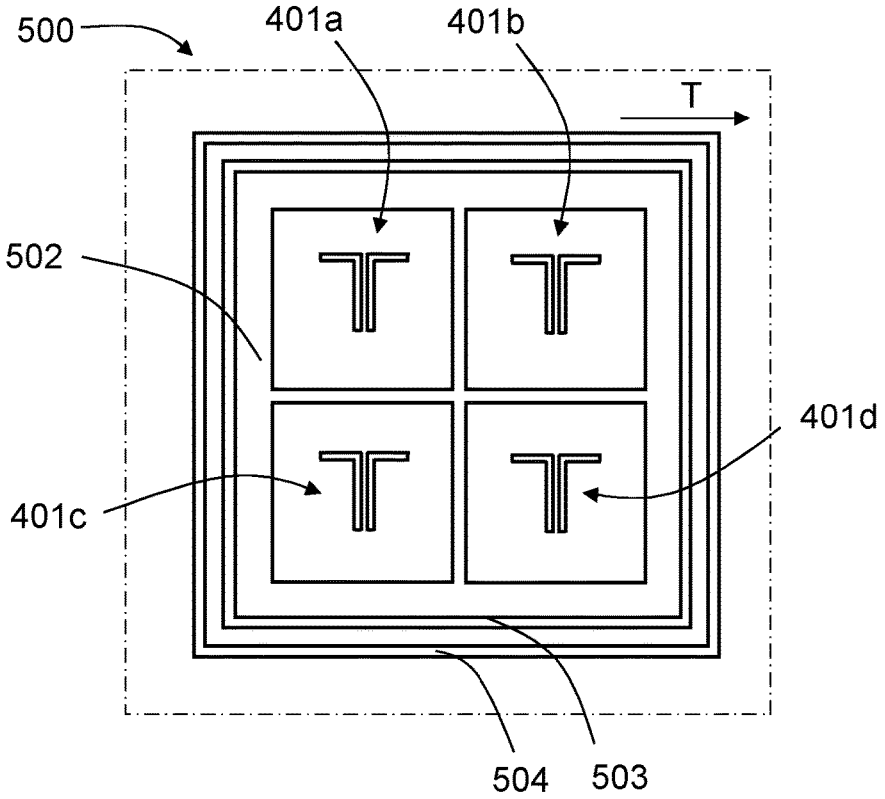
FIG. 5 shows a top view of a dipole antenna element array with surrounding grooves.

FIG. 5 shows a top view of a second example of an antenna structure 500 comprising a group of four squarely arranged dipole elements 401*a*, 401*b*, 401*c*, 401*d*, where the group of dipole elements 401*a*, 401*b*, 401*c*, 401*d* is surrounded by two grooves 503, 504 that form slots in an electrically conducting layer 502 that surrounds each one of the dipole elements 401*a*, 401*b*, 401*c*, 401*d*.

The grooves 403, 404; 503, 504 can be formed in any suitable way, alternatively according to some aspects as described with reference to FIG. 1B.

The dipole elements are as shown in FIG. 4 protruding from the dielectric material 405, but can according to some aspects lie in the plane of the electrically conducting layer 402, 502. In the latter case, the dipole elements 401; 401*a*, 401*b*, 401*c*, 401*d* and the electrically conducting layer 402, 502 are formed on the dielectric layer 405, and then the antenna structure forms a planar antenna structure.

The present disclosure also relates to an antenna mounting assembly 601 adapted to receive an antenna arrangement comprising at least one radiating aperture, adapted for a certain working frequency band. The antenna mounting assembly 601 comprises a surface structure 602 that is constituted by at least one surface part and is adapted to surround the antenna arrangement when mounted, and having a certain extension T. The surface structure 602 comprises two continuous grooves 603, 604, and is electrically conducting such that a continuous electromagnetic wall is formed in the surface structure 602 at the working frequency band such that propagation of surface waves via the at least one grooves 603, 604 is reduced.

According to some aspects, the antenna mounting assembly 601 comprises a plurality of fastening means 610 arranged for attachment of an antenna arrangement. By means of the antenna mounting assembly 601, propagation of surface waves can be reduced outside the grooves 603, 604 for any type of suitable antenna arrangement that is mounted to the antenna mounting assembly 601 and is surrounded by the grooves.

According to some aspects, the antenna mounting assembly 601 is formed in another structure, for example an aircraft wall or a building wall, where the walls are electrically conducting. Generally, the antenna mounting assembly 601 can be formed in an overall product assembly.

Each groove 603, 604 comprises a step in height h that is perpendicular to the extension T at the step in height h. The groves can be formed by punching or folding the surface structure 602, alternatively the surface structure 602 with the grooves 603, 604 can be formed by means of molding. The grooves 603, 604 can also be separate surface parts that are attached another surface part such that the surface structure 602 is formed.

For all examples mentioned, the step in height h is according to some aspects of a length that corresponds to a quarter wavelength for a frequency in the working frequency band, according to some further aspects a center frequency. According to some further aspects, the step in height h is optionally of a length that corresponds to an odd multiple of a quarter wavelength for a frequency in the working frequency band, according to some further aspects a center frequency.

In the following, the function of the grooves that enables reduction of propagation of surface waves via the groove will now be discussed more in detail.

Figure 6:
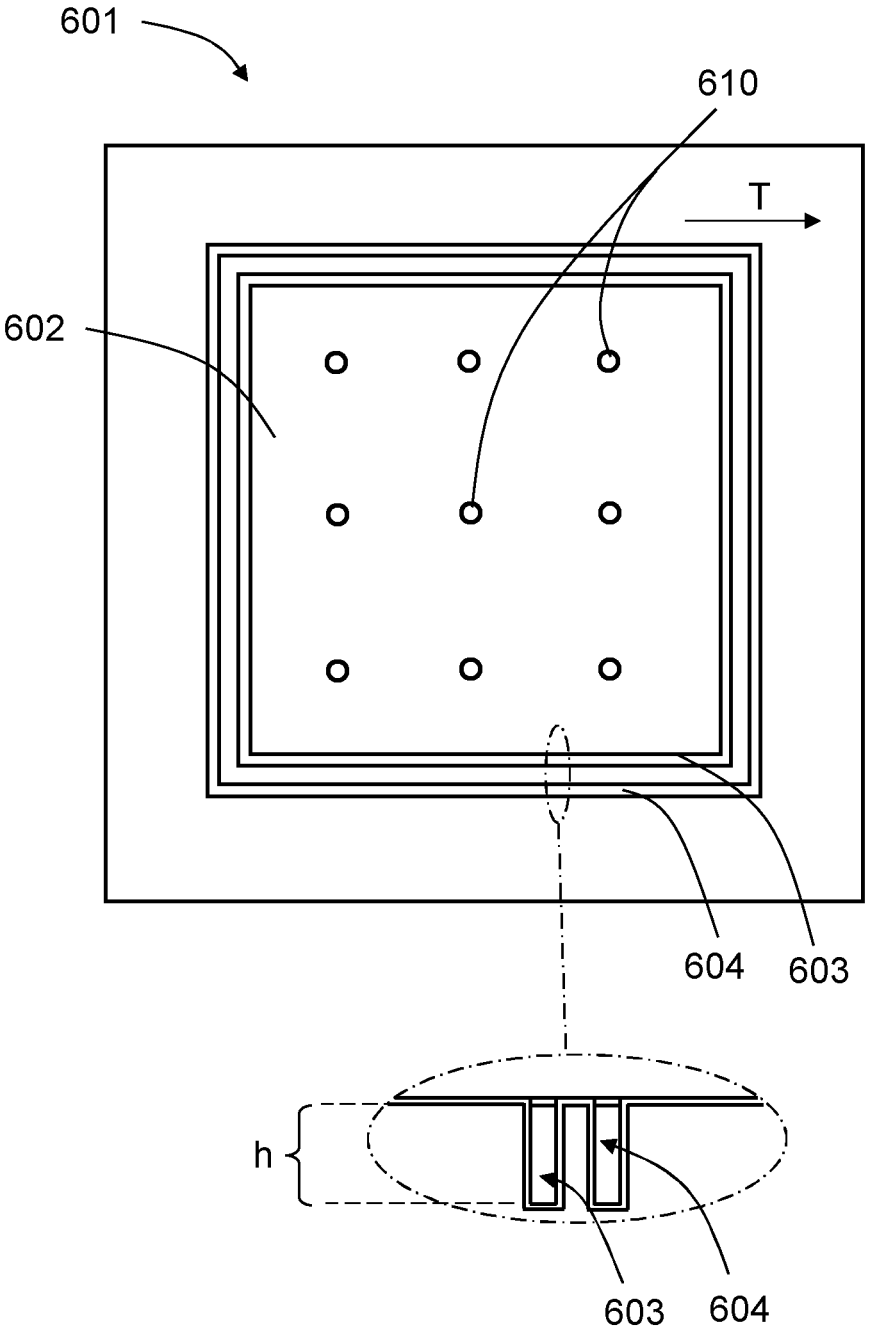
FIG. 6 shows a top view of an antenna mounting assembly with surrounding grooves.
Figure 12A:
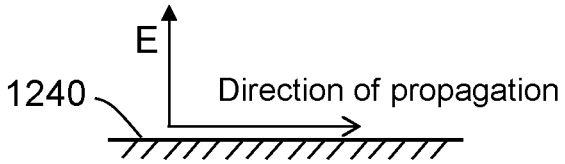
FIG. 12A-12D illustrate propagation of surface waves.
Figure 12B:
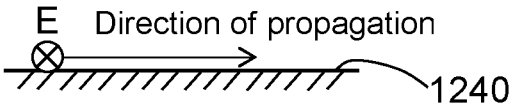

For the case of having a conducting surface, surface waves with a polarization parallel to a conducting surface, such as the electrically conducting layer of the antenna structures discussed, or the surface structure 602 of the antenna mounting assembly 601 as shown in FIG. 6, cannot propagate along such a conducting surface since the conducting surface forces the E-field E parallel to a conducting plane 1240 to vanish as schematically indicated in FIG. 12B, while surface waves with a polarization perpendicular to the conducting plane 1240 can propagate unattenuated, as schematically indicated in FIG. 12A.

Figure 12C:
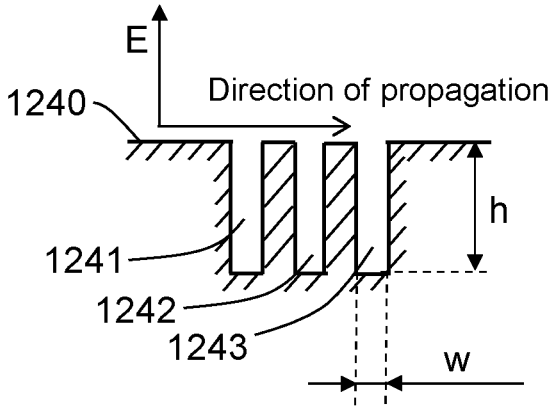

A method to prevent propagation of surface waves with polarization perpendicular the conducting plane 1240, is to introduce grooves 1241, 1242, 1243 or choke tracks, as step in heights h with a depth of about a quarter wave length of the present frequency, where the step in height h is perpendicular to the direction of propagation as schematically indicated in FIG. 12C. In this case, the surface wave will experience each choke track 1241, 1242, 1243 as an open parallel plate waveguide due to the depth of a quarter wavelength, and thus the surface wave will be prevented from propagating.

Figure 12D:
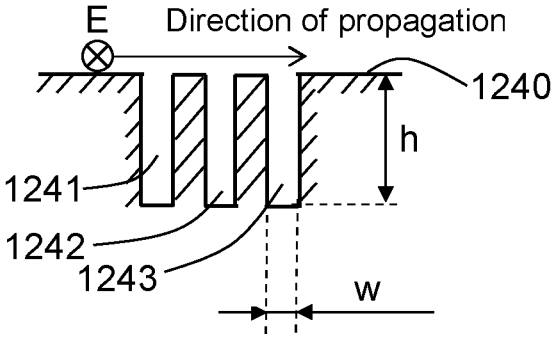

For the case of the polarization parallel to the conducting plane 1240, as schematically indicated in FIG. 12D, the surface wave will basically not be affected by a choke track 1241, 1242, 1243 since the parallel plate waveguide for this polarization will be in cut-off, according to some aspects having the width w of the chokes$<<\lambda/2$. In FIG. 12C and FIG. 12D, there are three choke tracks 1241, 1242, 1243 or grooves shown. Generally, the width w of the choke tracks should at least be $<\lambda/2$, and according to some aspects the width w is practically about $\lambda/10$.

The present disclosure relates to the above principles to improve the performance of antenna designs, for examples planar antenna structures that are integrated in multilayer PCB (printed circuit board) structures. Choke tracks are introduced to reduce propagation of unwanted surface waves along an electrically conducting surface and thereby unwanted scattered field interfering with the intended antenna radiation. The choke tracks, or grooves, in the present disclosure are, for the antenna structures described, formed by having two conducting planes, a ground plane, and an upper conducting plane with slots, where the ground plane and the upper conducting plane are electrically connected, for example by means of metal plating on formed groove walls or by means of via holes placed along the slots, forming a conducting surface with dielectric filled grooves. For an antenna mounting assembly the grooves are according to some aspects formed in a metal sheet.

Antenna radiation performance and stability are improved by the introduction of choke tracks, either in the antenna structure itself or at an antenna mounting assembly.

Figure 7:
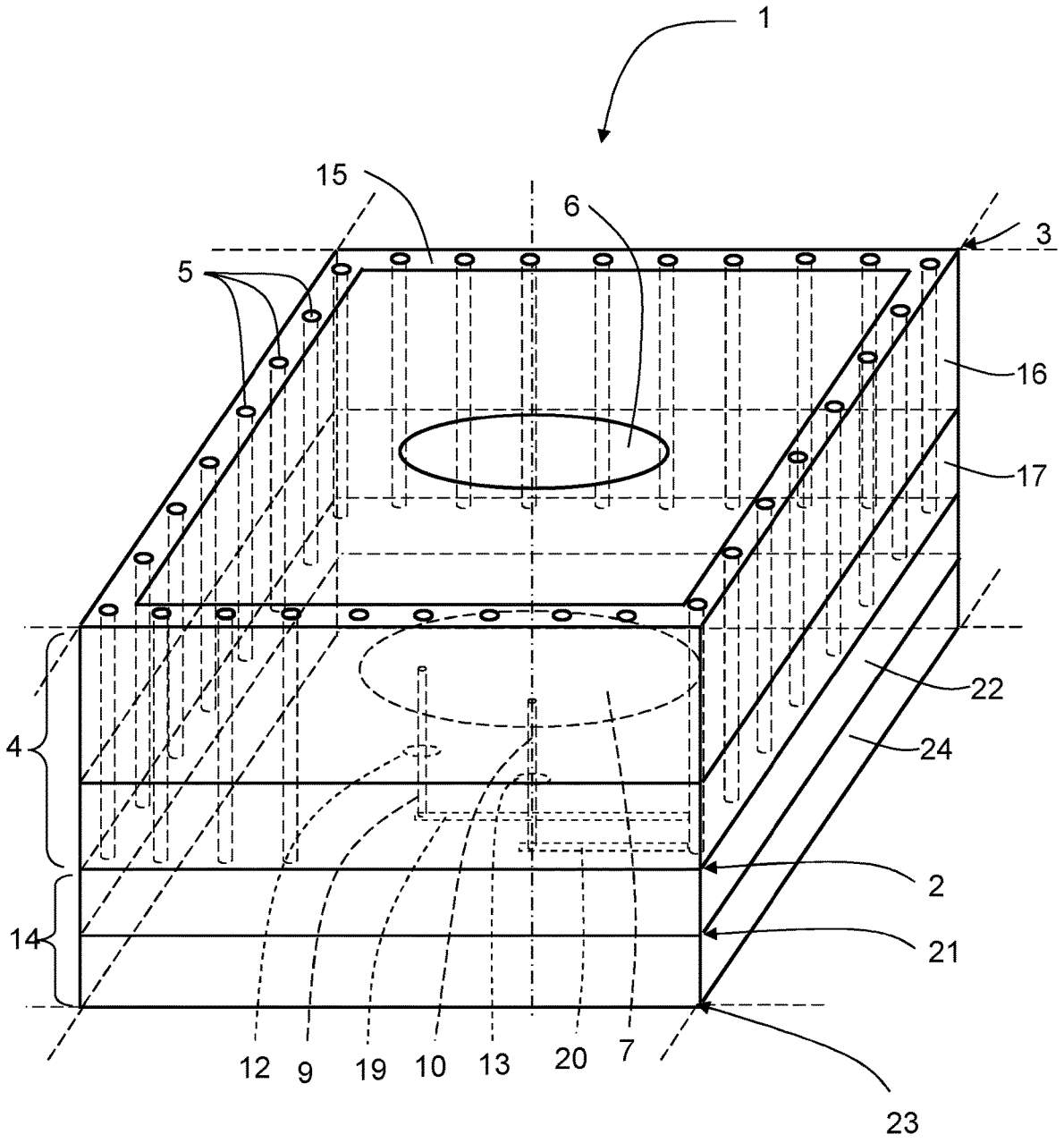
FIG. 7 shows a perspective view of a basic configuration for planar antenna element with stacked patches.

With reference to FIG. 7, a perspective view of a basic configuration for a planar antenna element with stacked patches is shown. The antenna element 1 comprises a lower conducting plane 2, an upper conducting plane 3 and an upper dielectric layer structure 4 that is positioned between the conducting planes 2, 3, where the upper dielectric layer structure 4 comprises a plurality of conducting vias 5 (only a few indicated for reasons of clarity) that electrically connect the conducting planes 2, 3 to each other. The vias 5 circumvent an upper radiating patch element 6 formed in the upper conducting plane 3, and a lowest intermediate radiating patch element 7 that is formed in the upper dielectric layer structure 4, where the lowest intermediate radiating patch element 7 is closer to the lower conducting plane 2 than the upper radiating patch element 6. It is to be noted that all vias 5 are not shown in FIG. 1, there is a gap for reasons of clarity, but of course the vias 5 are intended to run evenly distributed and completely circumvent the patch elements 6, 7.

In this manner, a cavity is formed in the upper dielectric layer structure 4, being limited by the vias 5, where the lower conducting plane 2 constitutes a cavity floor. The cavity height and shape are tuning parameters, which may vary for different bandwidth requirements.

Between the patch elements 6, 7 there is an upper first dielectric layer 16, and between the lowest intermediate radiating patch element 7 and the lower conducting plane 2 there is an upper second dielectric layer 17. According to some aspects, the upper conducting plane 3 comprises an electrically conducting frame 15 to which the vias 5 are connected.

According to the present disclosure, the lowest intermediate radiating patch element 7 is connected to a feed arrangement that comprises a first feeding probe 9 and a second feeding probe 10, where the feeding probes 9, 10 extend via corresponding apertures 12, 13 in the lower conducting plane 2 and are electrically connected to the lowest intermediate radiating patch element 7.

A power distribution arrangement 19, 20 (only schematically indicated) extends in a lower dielectric layer structure 14, where the lower conducting plane 2 is positioned between the upper dielectric layer structure 4 and the lower dielectric layer structure 14. The power distribution arrangement 19, 20 is adapted to feed the intermediate radiating patch element 7 with two orthogonal polarizations via the feeding probes 9, 10.

The lower dielectric layer structure 14 comprises a first signal layer 21, comprising the power distribution arrangement 19, 20 and a first lower dielectric layer 22. The lower dielectric layer structure 14 further comprises a bottom conducting plane 23 and a second lower dielectric layer 24 positioned between the bottom conducting plane 23 and the first signal layer 21. In this way, the first signal layer 21 is comprised in a stripline structure.

Here, the power distribution arrangement 19, 20 is shown to extend in one signal layer 21, but according to some aspects the lower dielectric layer structure 14 comprises several signal layers in which a power distribution arrangement extends.

According to some aspects, there can be one or more further intermediate radiating patch elements between the lowest intermediate radiating patch element 7 and the upper radiating patch element 6.

Figure 8:
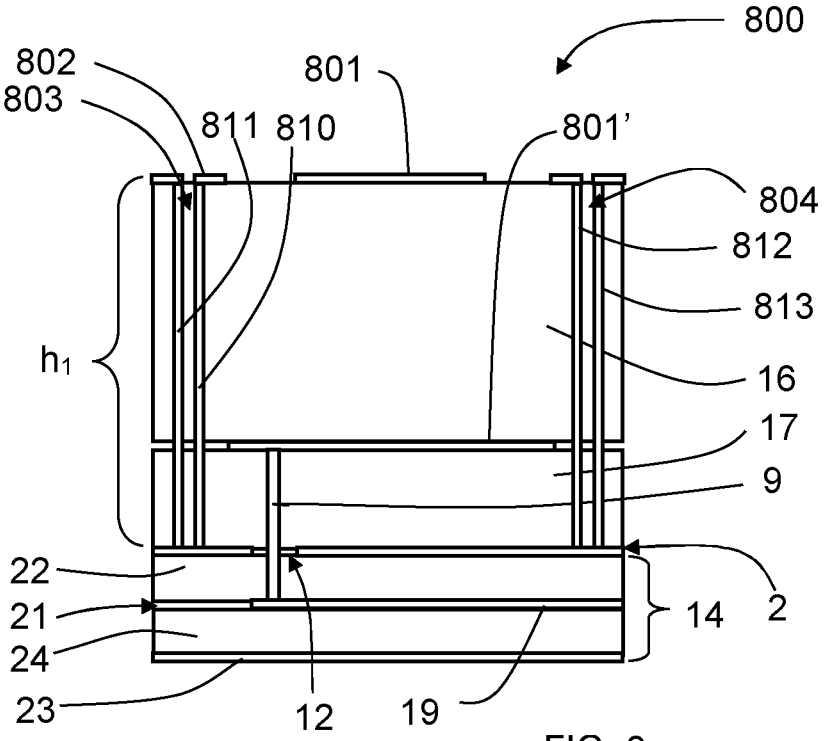
FIG. 8 shows a side view of a planar antenna element with surrounding grooves.

With reference to FIG. 8 showing a cut-open side view of a first example of a planar antenna structure 800 comprising a planar antenna element as described with reference to FIG. 7, such a planar antenna structure 800 can comprise grooves as described previously. More in detail, there is an upper patch element 801 and an intermediate patch element 801', where the upper patch element 801 is surrounded by a surface structure 802 that comprises an electrically conducting layer 802.

The planar antenna structure 800 comprises continuous grooves 803, 804, which grooves 803, 804 form slots in the electrically conducting layer 802. The grooves 803, 804 are formed by means of rows of vias 810, 811; 812, 813 that electrically connect the electrically conducting layer 802 to the lower conducting plane 2 such that the vias and the lower conducting plane 2 together form a continuous at least virtual electric wall that is electrically connected to the electrically conducting layer 102.

The grooves 803, 804 thus form a continuous electromagnetic wall in the electrically conducting layer 802 at the working frequency band such that propagation of surface waves via the grooves 803, 804 is reduced.

Each groove 803, 804 comprises a step in height $h_1$ that is perpendicular to the extension T at the step in height $h_1$. The two grooves 803, 804 shown here are here suitably connected such that one continuous groove is formed. This structure mainly corresponds to the structure discussed with reference to FIG. 1B.

Figure 9:
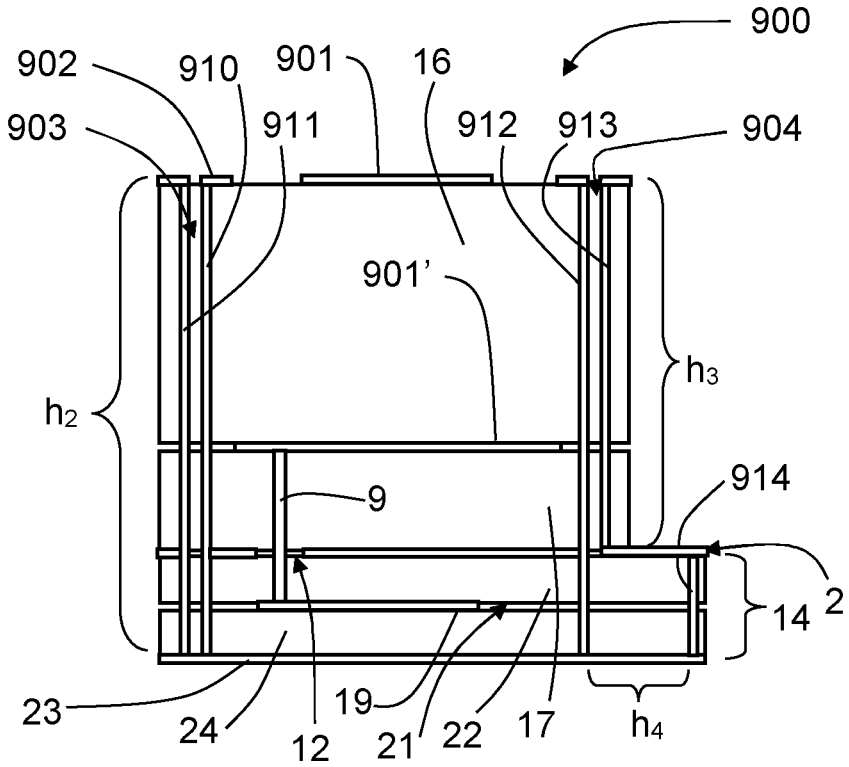
FIG. 9 shows a side view of a planar antenna element with different types of surrounding grooves.

FIG. 9 shows a cut-open side view of a second example of a planar antenna structure 900 comprising a planar antenna element as described with reference to FIG. 7. FIG. 9 corresponds to FIG. 8, showing an upper patch element 901 and an intermediate patch element 901', where the upper patch element 901 is surrounded by a surface structure 902 that comprises an electrically conducting layer 902.

The planar antenna structure 900 comprises a first continuous groove 903 and a second continuous groove 904, which grooves 903, 904 form slots in the electrically conducting layer 902. The first groove 903 is formed by means of first and second rows of vias 910, 911 that electrically connect the electrically conducting layer 902 to the bottom conducting plane 23 such that the vias and the bottom conducting plane 23 together form a continuous at least virtual electric wall that is electrically connected to the electrically conducting layer 902. The rows of vias 910, 911 are electrically connected to the lower conducting plane 2, but between the rows of vias 910, 911 the metal is removed from the lower conducting plane 2 such that the first groove 903 continues past the lower conducting plane 2 to the bottom conducting plane 23. The first groove 903 comprises a first step in height $h_2$ that is perpendicular to the extension T at the first step in height $h_2$.

The second groove 904 is formed by means of a third row of vias 912 that electrically connects the electrically conducting layer 902 to the bottom conducting plane 23, a fourth row of vias 913 that electrically connects the electrically conducting layer 902 to the lower conducting plane 2 at a second step in height $h_3$, and a fifth row of vias 915 that electrically connects the lower conducting plane 2 to the bottom conducting plane 23 at a horizontal fourth step in height $h_4$. The rows of vias 912, 913 are electrically connected to the lower conducting plane 2, but between the rows of vias 912, 913 the metal is removed from the lower conducting plane 2.

In this manner, a continuous, at least virtual, electric wall that is electrically connected to the electrically conducting layer 902 is formed for the second groove 903, where the equivalent step in height equals the sum of the second step in height $h_3$ and the fourth step in height $h_4$. In this way, the step in height can have different propagation directions along its extension, for example due to physical limitations.

The grooves 903, 904 thus form continuous electromagnetic walls in the electrically conducting layer 902 at the working frequency band such that propagation of surface waves via the grooves 803, 804 is reduced.

The two grooves 903, 904 shown here are here suitably used in different antenna structures and are shown in the same Figure for explanatory reasons. FIG. 8 and FIG. 9 thus illustrate how different heights can be obtained for the grooves in the case of vias being used. More than one grove can of course be used, in FIG. 10 described below there are two grooves.

Figure 10:
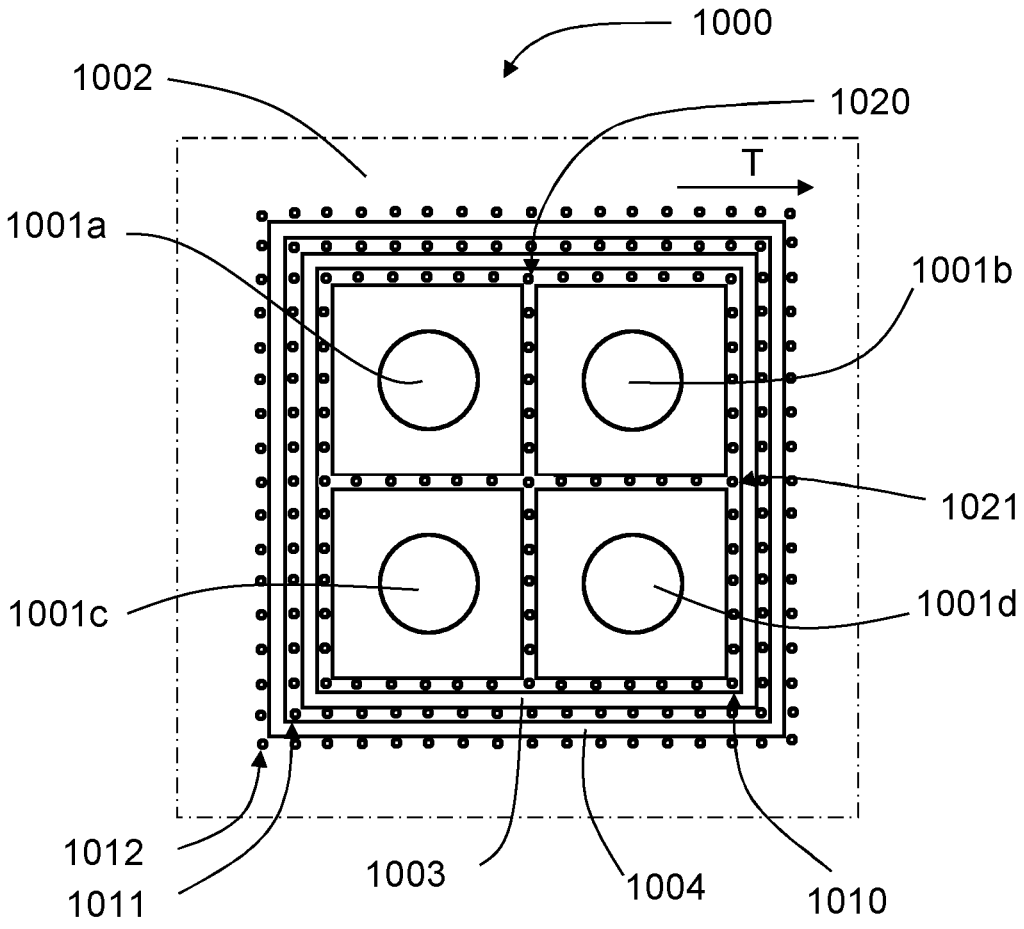
FIG. 10 shows a top view of a planar antenna element array with antenna elements according to FIGS. 7-9 with surrounding grooves.

FIG. 10 shows a top view of an example of a planar antenna structure 1000 comprising a group of four squarely arranged upper patch elements 1001*a*, 1001*b*, 1001*c*, 1001*d* that are of the kind described above with reference to FIG. 8 and FIG. 9, where the group of upper patch elements 1001*a*, 1001*b*, 1001*c*, 1001*d* is surrounded by two grooves 1003, 1004 that form slots in an electrically conducting layer 1002 that surrounds each one of the upper patch elements 1001*a*, 1001*b*, 1001*c*, 1001*d*. The first groove 1003 is here defined by a lower conducting plane that is not shown, a first row of vias 1010 and a second row of vias 1011, and the second groove 1004 is here defined by said lower conducting plane, the second row of vias 101 and a third row of vias 1012.

In this context, a row of vias can be interpreted as a sequentially running set of vias, where the set of vias can run in varying directions such that a row of vias can form a circumference, here a square or rectangular circumference.

Here, each one of the upper patch elements 1001*a*, 1001*b*, 1001*c*, 1001*d* is circumvented by vias by means of two further single rows of vias 1020, 1021 running between the upper patch elements 1001*a*, 1001*b*, 1001*c*, 1001*d*, and the first row of vias 1010, circumventing the group of upper patch elements 1001*a*, 1001*b*, 1001*c*, 1001*d*.

Figure 11:
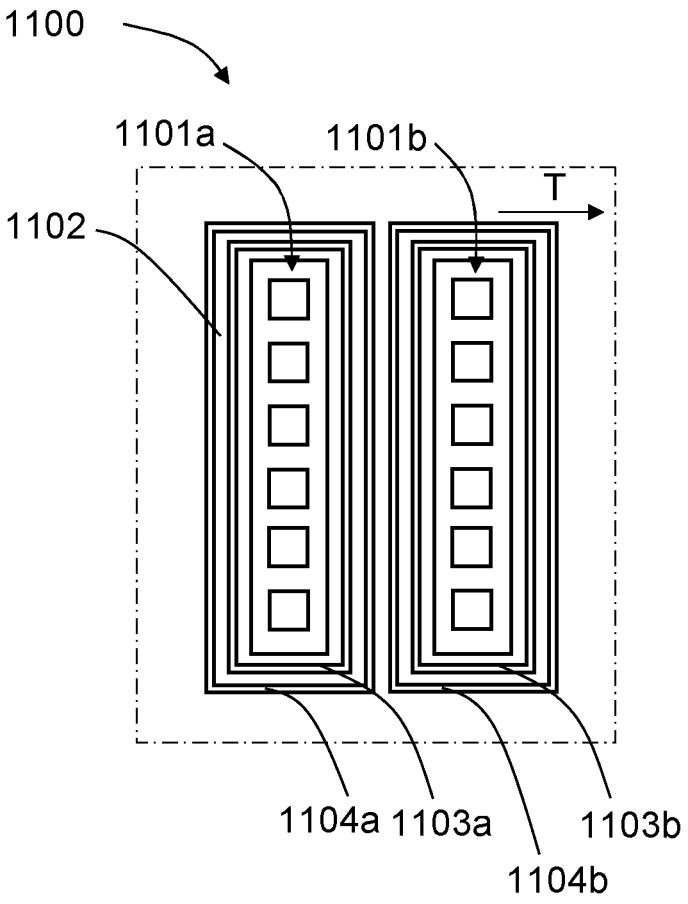
FIG. 11 shows a top view of a planar antenna element array with surrounding grooves separating adjacent subarrays.

With reference to FIG. 11, there is a further example of a planar antenna structure 1100; here a two-dimensional array antenna comprising a first linear array antenna 1101*a* and a second linear array antenna 1101*b*. A first continuous groove 1103*a* and a second continuous groove 1104*a* circumvent the first linear array antenna 1101*a*, and a third continuous groove 1103*b* and a fourth continuous groove 1104*b* circumvent the second linear array antenna 1101*b*. As in the previous examples, the grooves 1103*a*, 1104*a*; 1103*b*, 1104*b* form slots in an electrically conducting layer 1102, that surrounds the linear array antennas 1101*a*, 1101*b*, where each groove 1103*a*, 1104*a*; 1103*b*, 1104*b* generally is defined by an at least virtual electric wall that is electrically connected to the electrically conducting layer 1102. The grooves 1103*a*, 1104*a*; 1103*b*, 1104*b* form a continuous electromagnetic wall in the electrically conducting layer 1102 at the working frequency band such that propagation of surface waves via grooves 1103*a*, 1104*a*; 1103*b*, 1104*b* is reduced.

Figure 13:
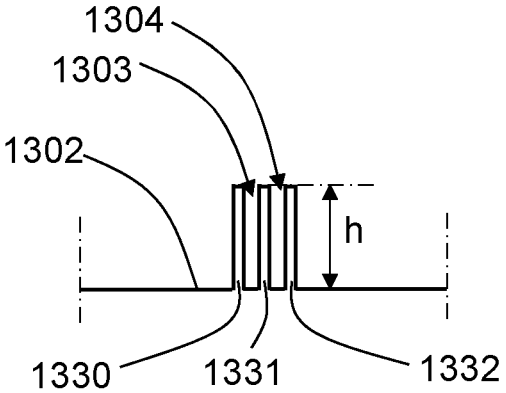
FIG. 13-14 show different types of surface structures.

The grooves can be formed by metal plated trenches, or vias in a dielectric material, as described above. With reference to FIG. 13, showing a side view of an additional example of how the grooves can be formed, there is an electrically conducting surface structure 1302 that comprises grooves 1303, 1304 that are formed by means of protruding walls 1330, 1331, 1332.

Figure 14:
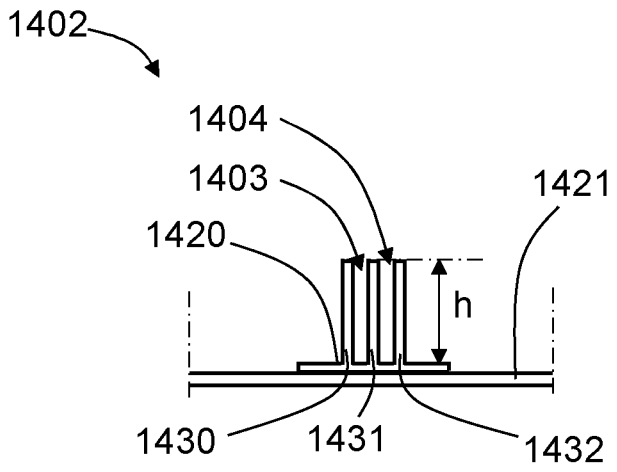

With reference to FIG. 14, showing a side view of an additional example of how the grooves can be formed, there is an electrically conducting surface structure 1402 that comprises an electrically conducting surface 1421 onto which a groove assembly 1420 is mounted. The groove assembly 1420 comprises grooves 1403, 1404 that are formed by means of protruding walls 1430, 1431, 1432.

The examples described with reference to FIG. 13 and FIG. 14 are applicable for any type of antenna structure or antenna mounting assembly, and can comprise any number of grooves. Several groove assemblies can be mounted adjacent to each other in order to obtain more grooves than one groove assembly comprises.

The present disclosure is not limited to the examples described above, but may vary freely within the scope of the appended claims. For example, the number of grooves used for reduce propagation of surface waves may vary, but there should be at least one groove.

A row of vias forming sequentially running set of vias can form a circumference of any suitable form such as oval, rectangular or polygonal.

In order to acquire an optimized design, the groove dimensions and positions are optimized together with the antenna structure designs for optimal performance.

The term virtual electric wall is well-known and according to some aspects means that at least for a certain frequency band or frequency bands, signals experience an electric wall.

According to some aspects, the working frequency band can comprise two or more sub-bands.

Generally, the present disclosure relates to a planar antenna structure 100, 200, 800, 900 comprising at least one radiating aperture 101, 201 801, 901, adapted for a certain working frequency band, and an electrically conducting surface structure 102, 202, 802, 902 that is constituted by at least one surface part and is surrounding at least one radiating aperture 101, 201, 801, 901 and having a certain extension T, wherein the planar antenna structure 100, 200, 800, 900 comprises at least one continuous groove 103, 104; 203, 204; 803, 804; 903, 904 that forms a slot in the surface structure 102, 202, 802, 902, where each groove 103, 104 is defined by an at least virtual electric wall that is electrically connected to the surface structure 102, 202, 802, 902 and forms a continuous electromagnetic wall in the surface structure 102, 202, 802, 902 at the working frequency band such that propagation of surface waves via the at least one groove 103, 104; 203, 204; 803, 804; 903, 904 is reduced.

According to some aspects, each groove 103, 104; 203, 204; 803, 804; 903, 904 comprises at least one step in height h, $h_1$, $h_2$, $h_3$, $h_4$, where each step in height h, $h_1$, $h_2$, $h_3$, $h_4$ at least initially is perpendicular to the extension T at the step in height h, $h_1$, $h_2$, $h_3$, $h_4$.

According to some aspects, each groove 103, 104; 203, 204; 803, 804; 903, 904 is formed in a dielectric material 105, 405; 16, 17, 22, 24.

According to some aspects, each groove 103, 104; 203, 204; 803, 804; 903, 904 comprises metal-plated walls 120, 420.

According to some aspects, each groove 103', 104'; 203, 204; 803, 804; 903, 904 comprises a plurality of via connections 110, 111, 112, 113; 810, 811, 812, 813; 910, 911, 912, 913; 1010, 1011, 1012.

According to some aspects, each groove 904 comprises a plurality of step in heights $h_3$, $h_4$, where two adjacent step in heights have mutually perpendicular extension.

According to some aspects, each groove 303, 304; 1003, 1004; 1103*a*, 1104*a*; 1103*b*, 1104*b* surrounds a plurality of radiating apertures 301*a*, 301*b*, 301*c*, 301*d*; 1001*a*, 1001*b*, 1001*c*, 1001*d*: 1101*a*, 1101*b*.

According to some aspects, the planar antenna structure 1100 comprises at least two pluralities of radiating apertures 1101*a*, 1101*b*.

According to some aspects, the grooves 1303, 1304; 1403, 1404 are formed by means of protruding walls 1330, 1331, 1332; 1430, 1431, 1432.

Generally, the present disclosure also relates to an antenna structure 100, 300, 400, 500, 1000 comprising a plurality of radiating apertures 301*a*, 301*b*, 301*c*, 301*d*; 401*a*, 401*b*, 401*c*, 401*d*; 801, 901; 1001*a*, 1001*b*, 1001*c*, 1001*d*, adapted for a certain working frequency band, and an electrically conducting surface structure 102, 302, 402, 1002 that is constituted by least one surface part and is surrounding at least two radiating apertures 301*a*, 301*b*, 301*c*, 301*d*; 401*a*, 401*b*, 401*c*, 401*d*; 1001*a*, 1001*b*, 1001*c*, 1001*d*, and having a certain extension T, wherein the antenna structure 100, 300, 400, 500, 1000 comprises at least one continuous groove 103, 104; 303, 304; 403, 404; 1003, 1004 that forms a slot in the surface structure 102, 302, 402, 1002, where each groove 103, 104; 303, 304; 403, 404; 1003, 1004 is defined by an at least virtual electric wall that is electrically connected to the surface structure 102, 302, 402, 1002 and forms a continuous electromagnetic wall in the surface structure 102, 302, 402, 1002 at the working frequency band such that propagation of surface waves via the at least one groove 103, 104; 303, 304; 403, 404; 1003, 1004 is reduced.

According to some aspects, each groove 103, 104; 303, 304; 403, 404; 1003, 1004 comprises at least one step in height h, $h_1$, $h_2$, $h_3$, $h_4$, where each step in height h, $h_1$, $h_2$, $h_3$, $h_4$ at least initially is perpendicular to the extension T at the step in height h, $h_1$, $h_2$, $h_3$, $h_4$.

According to some aspects, each groove 103, 104; 303, 304; 403, 404; 1003, 1004 is formed in a dielectric material 405; 16, 17, 22, 24.

According to some aspects, each groove 103, 104; 303, 304; 403, 404; 1003, 1004 comprises metal-plated walls 420.

According to some aspects, each groove 1003, 1004 comprises a plurality of via connections 1010, 1011, 1012.

According to some aspects, each groove 904 comprises a plurality of step in heights $h_3$, $h_4$, where two adjacent step in heights have mutually perpendicular extension.

According to some aspects, each groove 303, 304; 1003, 1004; 1103*a*, 1104*a*; 1103*b*, 1104*b* surrounds a plurality of radiating apertures 301*a*, 301*b*, 301*c*, 301*d*; 1001*a*, 1001*b*, 1001*c*, 1001*d*: 1101*a*, 1101*b*.

According to some aspects, the antenna structure 1100 comprises at least two pluralities of radiating apertures 1101*a*, 1101*b*.

According to some aspects, the grooves 1303, 1304; 1403, 1404 are formed by means of protruding walls 1330, 1331, 1332; 1430, 1431, 1432.

Generally, the present disclosure also relates to an antenna mounting assembly 601 adapted to receive an antenna arrangement comprising at least one radiating aperture, adapted for a certain working frequency band, where the antenna mounting assembly 601 comprises a surface structure 602 that is constituted by at least one surface part and is adapted to surround the antenna arrangement when mounted, and having a certain extension T, wherein the surface structure 602 comprises at least one continuous groove 603, 604, where the surface structure 602 is electrically conducting and each groove 603, 604 forms a continuous electromagnetic wall at the working frequency band such that propagation of surface waves via the at least one groove 603, 604 is reduced.

According to some aspects, each groove 603, 604 comprises at least one step in height h, where each step in height h at least initially is perpendicular to the extension T at the step in height h.

According to some aspects, the antenna mounting assembly 601 comprises a plurality of fastening means 610.

According to some aspects, the grooves 1303, 1304; 1403, 1404 are formed by means of protruding walls 1330, 1331, 1332; 1430, 1431, 1432.

The invention claimed is:

1. A planar antenna structure, comprising:

at least one radiating aperture adapted for a certain working frequency band;

an electrically conducting surface structure, not electrically connected to the at least one radiating aperture, that is constituted by at least one surface part and is surrounding at least one radiating aperture and having a certain extension;

at least one continuous groove that forms a slot in the surface structure, the at least one groove surrounding the at least one radiating aperture, where each groove is defined by an at least virtual electric wall that is electrically connected to the surface structure and forms a continuous electromagnetic wall in the surface structure at the working frequency band such that propagation of surface waves via the at least one groove is reduced.

2. The planar antenna structure of claim 1, wherein each groove comprises at least one step in height, where each step in height at least initially is perpendicular to the extension at the step in height.

3. The planar antenna structure of claim 1, wherein each groove is formed in a dielectric material.

4. The planar antenna structure of claim 3, wherein each groove comprises metal-plated walls.

5. The planar antenna structure of claim 3, wherein each groove comprises a plurality of via connections.

6. The planar antenna structure of claim 1, wherein each groove comprises a plurality of steps in height, where two adjacent steps in height have mutually perpendicular extension.

7. The planar antenna structure of claim 1, wherein each groove surrounds a plurality of radiating apertures.

8. The planar antenna structure of claim 1, wherein at least one groove is formed by protruding walls.

9. An antenna structure, comprising:

a plurality of radiating apertures adapted for a certain working frequency band;

an electrically conducting surface structure, not electrically connected to any of the plurality of radiating apertures, that is constituted by least one surface part and is surrounding at least two of the radiating apertures, and having a certain extension, at least one continuous groove that forms a slot in the surface structure, the at least one groove surrounding at least two of the radiating apertures, where each groove is defined by an at least virtual electric wall that is electrically connected to the surface structure and forms a continuous electromagnetic wall in the surface structure at the working frequency band such that propagation of surface waves via the at least one groove is reduced.

10. The antenna structure of claim 9, wherein each groove comprises at least one step in height, where each step in height at least initially is perpendicular to the extension at the step in height.

11. The antenna structure of claim 9, wherein each groove is formed in a dielectric material.

12. The antenna structure of claim 11, wherein each groove comprises metal-plated walls.

13. The antenna structure of claim 11, wherein each groove comprises a plurality of via connections.

14. The antenna structure of claim 9, wherein each groove comprises a plurality of steps in height, where two adjacent steps in height have mutually perpendicular extension.

15. The antenna structure of claim 9, wherein each groove surrounds a plurality of radiating apertures.

16. The antenna structure of claim 9, wherein at least one groove is formed by protruding walls.

17. An antenna mounting assembly adapted to receive an antenna arrangement, the antenna arrangement comprising at least one radiating aperture adapted for a certain working frequency band, where the antenna mounting assembly comprises:

a surface structure that is constituted by at least one surface part, not electrically connected to the antenna arrangement when mounted, and is adapted to surround the antenna arrangement when mounted, the surface structure having a certain extension;

wherein the surface structure comprises at least one continuous groove surrounding the antenna arrangement when mounted;

wherein the surface structure is electrically conducting;

wherein each groove forms a continuous electromagnetic wall at the working frequency band such that propagation of surface waves via the at least one groove is reduced.

18. The antenna mounting assembly of claim 17, wherein each groove comprises at least one step in height, where each step in height at least initially is perpendicular to the extension at the step in height.

19. The antenna mounting assembly of claim 17, wherein the antenna mounting assembly comprises a plurality of fastening means.

20. The antenna mounting assembly of claim 17, wherein the at least one groove is formed by protruding walls.

* * * * *